United States Patent [19]

Gryctko et al.

[11] 3,946,345

[45] Mar. 23, 1976

[54] NARROW MULTI-POLE CIRCUIT BREAKER HAVING INERTIA ACTUATED OVERTRAVEL FOR LATCH RELEASE

[75] Inventors: Carl E. Gryctko, Haddon Heights, N.J.; Charles T. Robins, Swarthmore, Pa.

[73] Assignee: I-T-E Imperial Corporation, Spring House, Pa.

[22] Filed: Mar. 4, 1975

[21] Appl. No.: 555,167

[52] U.S. Cl. ..... 335/9; 335/10; 335/175

[51] Int. Cl.[2] ..... H01H 75/12

[58] Field of Search ..... 335/8, 9, 10, 23, 35, 175; 337/71, 52, 75

[56] References Cited

UNITED STATES PATENTS 3,194,922 7/1965 Ellsworth et al. ..... 335/10 X

*Primary Examiner*—G. Harris

*Attorney, Agent, or Firm*—Ostrolenk, Faber, Gerb & Soffen

[57] ABSTRACT

A plurality of single pole circuit breakers stacked side-by-side are interconnected by a tie rod connecting the magnetic armatures of their respective instantaneous trip means. When one pole is caused to trip because of a fault condition, a driving formation on the releasable cradle of the faulted pole delivers a hammerlike blow to a cam means on the magnetic armature. The energy imparted to the armature by this blow causes the latch carried thereby to move in the tripping direction substantially beyond the point required for releasing the cradle latch in the faulted phase. This added movement assures that the tie rod shall transmit sufficient motion to all non-faulted poles to cause tripping thereof.

8 Claims, 4 Drawing Figures

FIG. 1.
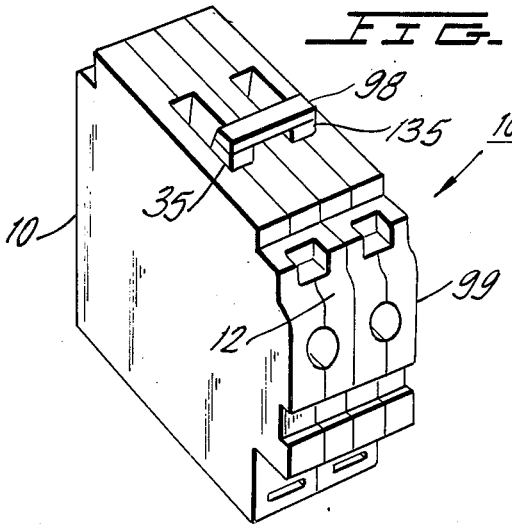
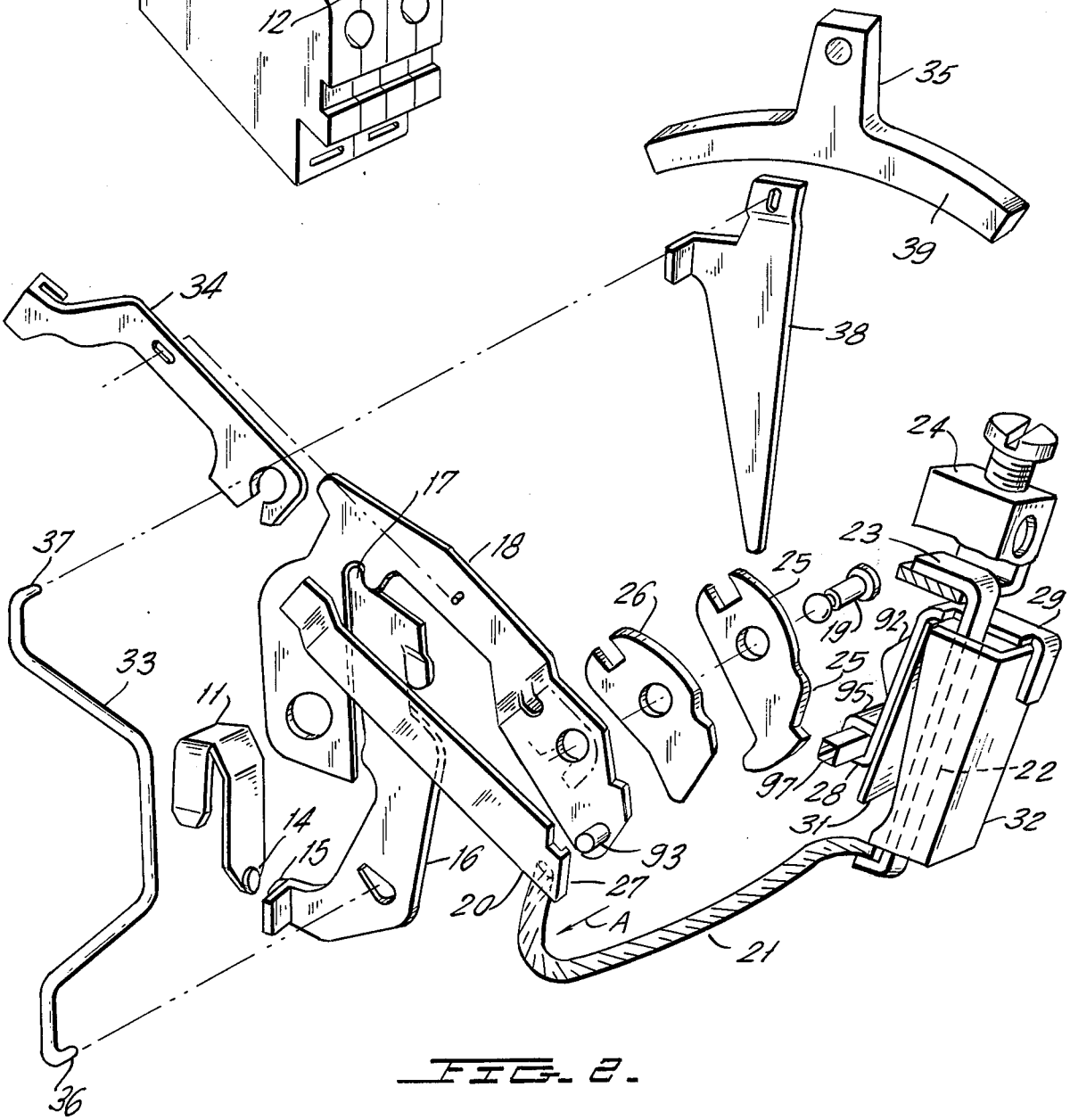
FIG. 2.

NARROW MULTI-POLE CIRCUIT BREAKER HAVING INERTIA ACTUATED OVERTRAVEL FOR LATCH RELEASE

This invention relates to multipole circuit breakers in general and more particularly relates to a circuit breaker of this type constructed to assure that fault current tripping of one phase will cause tripping of non-faulted phases. Relatively low current multi-pole molded case circuit breakers are often constructed by assembling a plurality of single pole units side-by-side and mechanically interconnecting their trip units by means of a tie bar. Opening of one pole because of a fault current condition will cause trip units in the other poles to be actuated. Molded case circuit breakers having a continuous rating of between 10 and 20 amperes are often constructed so that their housings are ½ inch wide. A construction of this type is illustrated in U.S. Pat. No. 3,147,353, issued Sept. 1, 1964, to J. H. Leonard for a Contact Weld Breaking Means. Because of this type of circuit breaker being so thin, the electrical and mechanical operating elements are extremely crowded, and as a result only slight movements of the automatic trip elements can be achieved.

Coupling the relatively small movements of the trip elements with parts tolerances and possible misalignment of elements results in a substantial problem when a plurality of pole units are assembled as a multi-pole device. That is, in a multi-pole device of this type, the basic compact design tolerances and misalignments may combine adversely so that tripping of one pole will not result in sufficient movement in the other poles to cause tripping thereof.

In accordance with the instant invention, the inter-pole tie between automatic trip units is achieved by a rod connected directly to the movable armature of the magnetic trip means. The armature is provided with a cam means operatively positioned for engagement by a driving formation on the cradle of the contact operating mechanism, which cradle is released upon actuation of either the instantaneous (magnetic) or time delay (thermal) trip means.

Actuation of the magnetic trip means in a faulted pole requires only slight movement of the armature in this pole, and this slight movement may not bring about sufficient movement of the armature in a non-faulted pole to cause cradle release therein. However, when the cradle is latched, there is a substantial distance between the driving formation on the cradle and the cam means on the armature. This distance is such that as the cradle is released, there is substantial cradle motion, hence substantial buildup of inertia, before the driving formation engages the cam means. Inertial energy of the driving formation is transmitted to the cam means upon engagement therewith and is of sufficient magnitude to deliver a hammer-like blow which drives the armature substantially past the minimum latch release position. This added motion of the armature past the minimum latch release position assures that there will be sufficient motion transmitted to the armatures of all non-faulted poles to cause tripping thereof.

Accordingly, a primary object of the instant invention is to provide a novel compact multi-pole molded case circuit breaker in which there is an inter-pole trip means constructed so as to assure tripping of all non-faulted poles upon automatic tripping of a single pole.

Another object is to provide a circuit breaker of this type in which each pole unit is constructed so that upon automatic tripping the armature will move considerably past the minimum position required for release of a latchable cradle of the contact operating mechanism.

Still another object is to provide a circuit breaker of this type in which upon automatic tripping of a pole substantial cradle inertia is developed prior to engagement of a cradle driving formation with a cam means on the instantaneous trip armature, with this inertia energy serving to drive the armature in the faulted pole substantially beyond its latch release position, thereby assuring that armatures in the other poles will move sufficiently to cause release of their respective mechanism latches.

These objects as well as other objects of this invention shall become readily apparent after reading the following description of the accompanying drawings in which:

FIG. 1 is a perspective of a two-pole molded case circuit breaker constructed in accordance with teachings of the instant invention.

FIG. 2 is an exploded perspective showing the major current carrying and contact operating elements of one pole unit of the circuit breaker of FIG. 1.

In FIG. 3 the contacts are closed and in FIG. 4 the contacts are in tripped open position, with the contact operating mechanism cradle and the instantaneous trip magnetic armature in engagement.

Figure 3:
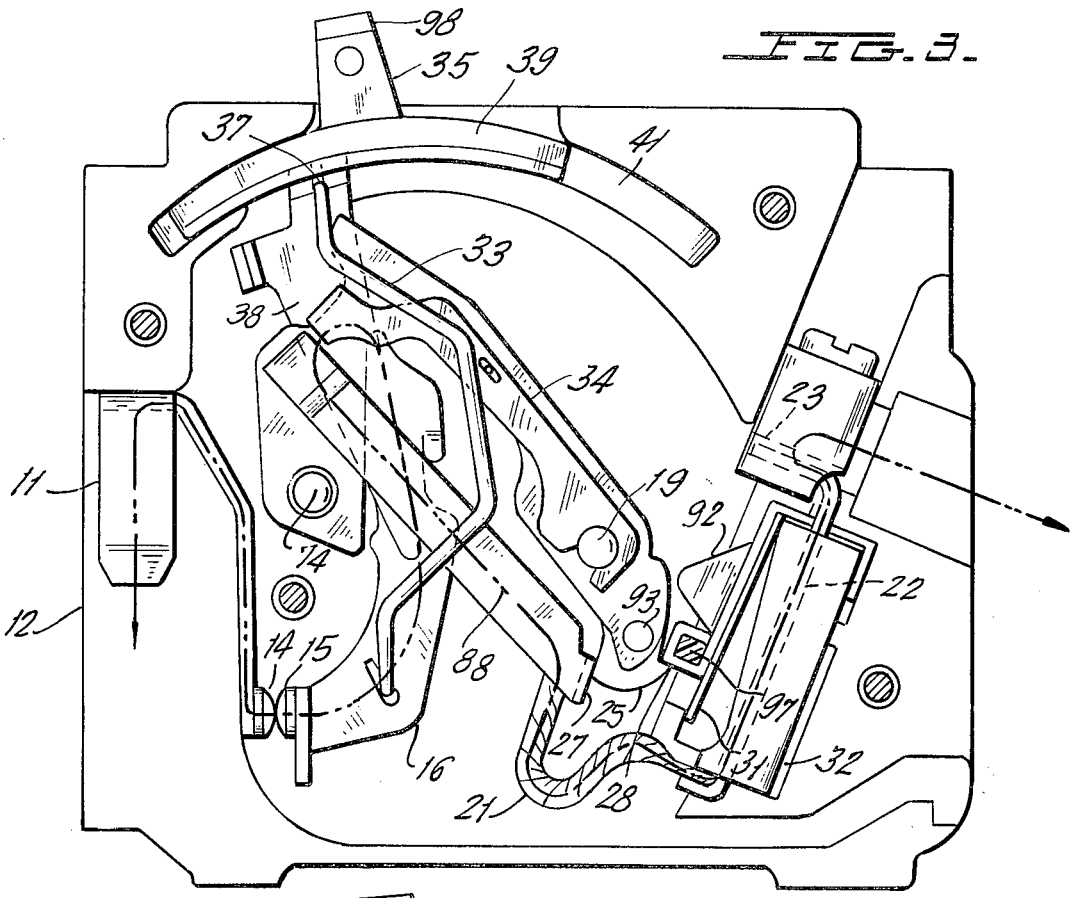
FIGS. 3 and 4 are side elevations of one pole unit of the circuit breaker of FIG. 1, with the near housing wall removed to reveal the operating elements.
Figure 4:
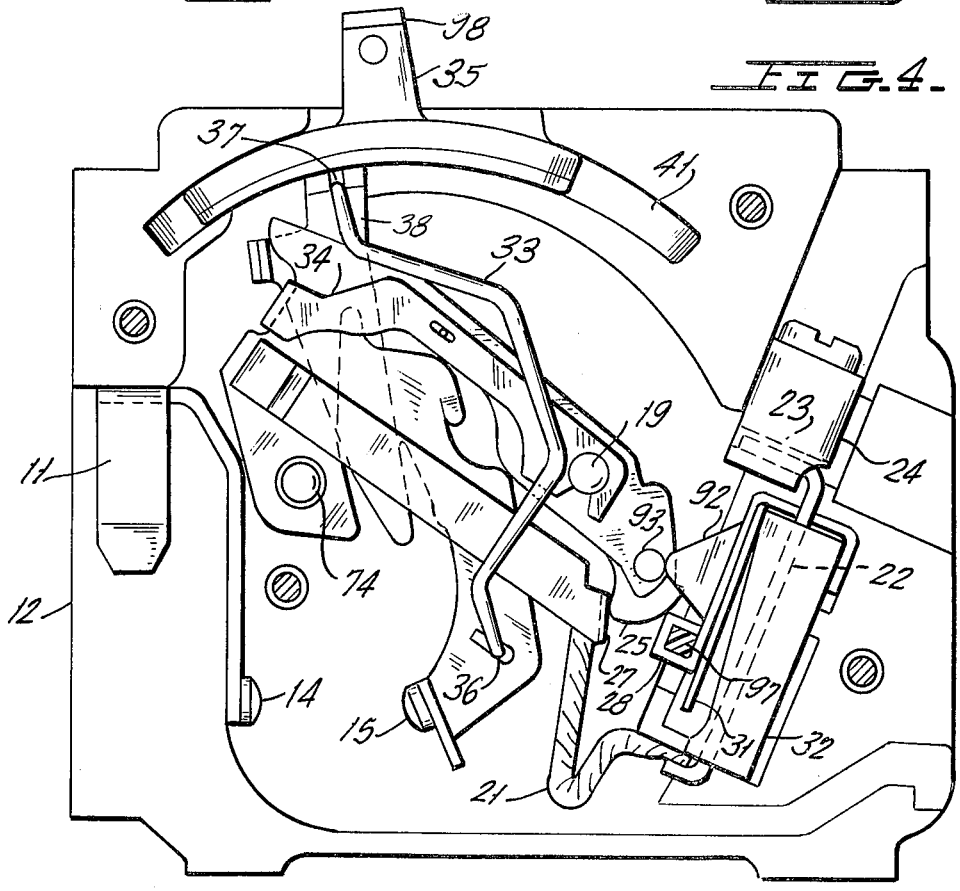

Now referring to the figures. Two-pole circuit breaker 100 is adapted to be mounted in a panelboard of the type illustrated in U.S. Pat. No. 3,767,977 issued Oct. 23, 1973, to A. Bachman for an Electric Distribution Panel Having Extruded Buses and Contact Stabs. Circuit breaker 100 is constructed of substantially identical half-inch wide molded case circuit breaker pole units 10, 99 stacked in abutting side-by-side relationship. Operating handles 35, 135 are connected by handle tie 98. As will be hereinafter explained, tie rod 97 extends through housing apertures (not shown) and interconnects the instantaneous trip devices of both pole units 10 and 99.

Circuit breaker pole unit 10 is generally of the type described in detail in U.S. Pat. No. 3,147,353 issued Sept. 1, 1964, to J. H. Leonard for a Contact Weld Breaking Means. The load current path (indicated by heavy broken line 88 in FIG. 3) through circuit breaker 10 consists of line terminal 11 at the left end of molded housing part 12, stationary contact 14, movable contact 15 at the lower end of movable contact arm 16 pivoted at its upper end 17 against latchable cradle 18, through a section of cradle 18, through bimetal strip 20, flexible braid 21 and load terminal extension 22 to load terminal 23 connected to wire grip 24 located at the right side of housing part 12 near the upper end thereof.

Releasable cradle 18 is normally maintained in its latched or reset position by intermediate latch 25 pivotally mounted to cradle 18 on insulating pin 19, with insulating sheet 26 being interposed between intermediate latch 25 and cradle 18. Conducting leaf spring element 34 secures pin 19 to cradle 18. Intermediate latch 25 engages the in-turned free end 27 of bimetal 20 and also engages latch surface 28 formed by the generally square folded-over out-turned free end portion 95 of modified U-shaped spring 29 welded to tripping armature 31 and biasing the latter away from U-shaped magnetic yoke 32. The latter surrounds load terminal extension 22 which acts as an energizing turn for magnet 31, 32. Main operating spring 33 is a tension member connected at its lower end 36 to contact arm 16 and at its upper end 37 to downward extension 38 of manual operating handle 35 whose arcuate lower section 39 is journalled for movement within arcuate slot 41 of housing part 12. Tie rod 97 extends through the openings in free end portion 95 of spring 29 in each pole unit 10, 99 to mechanically connect movable magnetic armatures 31 of both pole units 10, 99.

Under moderate overload conditions current carried by circuit breaker 10 flows through bimetal strip 20, to heat the latter. This heating causes the free latching end 27 of bimetal 20 to deflect outward, or in the direction of arrow A in FIG. 2, until latching tip 27 clears intermediate latch 25. At this point the upward force exerted by main spring 33 on cradle 18 and the elements mounted thereto causes intermediate latch 25 to pivot clockwise and clear latch surface 28 so that cradle 18 is unlatched and pivots counterclockwise about case pivot 74 until pivot point 17 at the upper end of contact arm 16 moves to the left of the line of action for main spring 33. When this occurs, main spring 33 pulls contact arm 16 to the right, causing movable contact 15 to separate from stationary contact 14, to bring about opening of circuit breaker 10.

Release of cradle 18 causes pin 93, disposed thereon in the vicinity of auxiliary latch 25, to engage cam 92 projecting from armature 31 at a location above square formation 95 of spring 29. Cam 92 is constructed either of a resilient or a relatively rigid material. Engagement of cam 92 by driving formation 93 moves armature 31 toward magnet 32 through a distance substantially greater than the distance required for latching surface 28 to move in order to release auxiliary latch 25 during the occurrence of severe overloads. Sufficient movement of armature 31 in the tripping direction is assured because of inertial energy generated by movement of cradle 18.

This inertial energy is remarkably great in that with cradle 18 latched there is a substantial distance between driving formation 93 and cam 92. Thus, there is a substantial distance of free travel for cradle 18 before driving pin 93 engages cam 92, so that the latter is struck a hammer-like blow causing high speed movement of armature 31 and the inertia thereof causes it to move in the tripping direction considerably past the position required for minimal motion of latching surface 28 to release cradle 18. This added motion of armature 31 in the faulted pole assures that sufficient motion is transmitted through tie rod 97 to cause tripping of the non-faulted pole.

Under severe overload conditions armature 31 is attracted to magnet 32, thereby moving latching surface 28 to the right with respect to FIG. 3 until portion 95 moves to the right of auxiliary latch 25 at which time cradle 18 is free to pivot counterclockwise about pivot formation 74 to bring about separation of cooperating contacts 14, 15. Additional motion in the tripping direction is then imparted to armature 31 as a result of cam 92 being struck a hammerlike blow by cradle carried driving formation 93, in the manner previously explained.

While this invention is illustrated in the drawings as consisting of circuit breaker pole units stacked adjacent to each other, the invention is not so limited but is broad enough to include an arrangement in which there is a considerable space between pole units as in copending U.S. patent application Ser. No. 505,682 filed Sept. 13, 1974, by C. E. Gryctko et al. for a Two Pole Ground Fault Circuit Protector, and assigned to the assignee of the instant invention.

Although in the foregoing preferred embodiments have been discussed, many variations and modifications will now become apparent to those skilled in the art and it is therefore understood that this invention is not limited by the disclosure but only by the appending claims.

The embodiments of the invention in which an exclusive privilege or property is claimed are defined as follows:

1. A circuit breaker having a plurality of poles and including, for each pole thereof, cooperating contact means, releasable operating means for opening and closing said contact means, latch means for maintaining said operating means in operative condition to close said contact means, and fault current responsive trip means which when actuated trips said latch means to release said operating means which renders the latter inoperative to either close or maintain said contact means closed; said trip means including an electromagnet comprising a relatively stationary magnetic frame and a magnetic armature movable from a normal forward position rearward through a latch releasing position upon predetermined energization of said electromagnet, tie means interconnecting said armatures of said plurality of poles for simultaneous operation thereof; biasing means for said armature urging the latter toward said normal position; within a pole carrying fault current said armature being moved rearward magnetically past said latch releasing position; said trip means also including thermally responsive means for automatically releasing said operating means at overload current below said fault current; said operating means upon release thereof by said thermally responsive means operatively engaging said armature thereby moving the armatures of all poles substantially to the rear of their said latch releasing positions.

2. A circuit breaker as set forth in claim 1 also including cam means and a driving formation operatively engageable therewith upon release of said operating means, said armature mounting one of said cam means and said driving formation, said operating means mounting the other of said cam means and said formation, said formation normally being spaced from said cam means by a substantial distance whereby release of said operating means is effective to build up substantial inertia force in said operating means and elements carried thereby for moving said armature by engagement between the cam means and the formation.

3. A circuit breaker as set forth in claim 2 in which said inertia force acting on said armature upon engagement of the driving formation and the cam means is effective to drive said armature to the rear of the most rearward point of the armature at which the driving means and cam means are engaged.

4. A circuit breaker as set forth in claim 2 in which the cam means is on the armature and the driving formation is on the operating means.

5. A circuit breaker as set forth in claim 4 in which the cam extends forward from the armature.

6. A circuit breaker as set forth in claim 5 in which the cam means is relatively rigid.

7. A circuit breaker as set forth in claim 5 in which the cam means is resilient.

8. A circuit breaker as set forth in claim 5 in which the operating means includes a pivoted cradle and the driving means extends transversely from the cradle generally parallel to its pivot axis.

* * * * *